United States Patent [19]

Jervis

[11] Patent Number: 4,741,709

[45] Date of Patent: May 3, 1988

[54] GEL FILLED ENCLOSURE

[75] Inventor: James E. Jervis, Atherton, Calif.

[73] Assignee: Raychem Corporation, Menlo Park, Calif.

[21] Appl. No.: 801,017

[22] Filed: Nov. 22, 1985

[51] Int. Cl.[4] ..... H01R 13/52

[52] U.S. Cl. ..... 439/521; 439/271

[58] Field of Search ..... 339/116 R, 94 R, 94 M, 339/116 C, 115 R, 114 R; 174/74 A, 76, 77 R; 439/199, 271, 519, 521

[56] References Cited

U.S. PATENT DOCUMENTS

| | | | |
|---|---|---|---|
| 2,109,616 | 3/1938 | Gort | 174/76 |
| 3,395,382 | 7/1968 | Weagant | 339/116 R |
| 3,504,099 | 3/1970 | Beihhaur | 174/76 |
| 3,937,870 | 2/1976 | Bumpstead et al. | 174/76 |
| 4,423,918 | 1/1984 | Filreis et al. | 339/115 R |
| 4,610,738 | 9/1986 | Jervis | 174/76 |
| 4,634,207 | 1/1987 | Debbaut | 339/116 C |

*Primary Examiner*—Eugene F. Desmond

*Attorney, Agent, or Firm*—Dennis E. Kovach; Herbert G. Burkard

[57] ABSTRACT

An apparatus for protecting a substrate includes a gel which is relatively soft and yet elastic, the gel being contained within first and second containers sized such that confronting surfaces thereof come in contact so as to substantially limit further relative telescopic movement between the containers when voids within the containers are filled by the gel. A gasket is disposed on one of the confronting surfaces of the containers to further isolate a substrate being protected from environmental contaminants.

4 Claims, 2 Drawing Sheets

GEL FILLED ENCLOSURE

BACKGROUND OF THE INVENTION

The present invention relates to an apparatus for protecting a substrate.

Numerous articles and methods have been proposed in the prior art for protecting substrates from the environment, especially from moisture in the environment. Typical solutions are to provide a container which completely surrounds a substrate, with some solutions further utilizing a grease disposed within the containers for keeping contaminants such as water away from the substrate. A disadvantage of greases is that they tend to be messy, especially when exposed to elevated temperatures due to their viscous nature.

Methods have been proposed in the prior art for deforming three-dimensional gels around substrates to be protected, such gels having finite elongation properties, and also being relatively soft. However, apparatuses utilizing such gels are disadvantageous since a craftsman oftentimes cannot tell when a proper amount of compression force has been exerted onto the gel, and a further disadvantage is that sometimes the gel itself is not adequately protected from the environment which reduces its useful operative life.

SUMMARY OF THE INVENTION

Accordingly, it is an object of the present invention to eliminate the above-noted drawbacks, and to provide an apparatus for protecting a substrate which utilizes a three-dimensional open loop structured gel which is relatively soft yet elastic which is capable of being deformed about a substrate to be protected, the apparatus having means for indicating when the gel has been properly compressed and means for at least partially protecting the gel from the environment.

These and other objects are achieved by an apparatus which includes a gel having a cone penetration between 100 and 350 ($10^{-1}$ mm) and an ultimate elongation in excess of 100%, first and second containers for containing the gel, and means for urging the containers together such that a surface of the gel is deformed about a substrate to be protected, sidewalls of the containers being telescopically mateable and the container being filled with the gel by an amount such that when voids within the container are substantially eliminated by urging the containers together confronting surfaces of the containers come in contact so as to substantially limit further relative telescopic movement of the containers towards one another, preferably at least one of the containers including a gasket formed on one of the confronting surfaces so as to form a seal between the confronting surfaces of the containers so as to provide a further moisture barrier for the substrate being protected and the gel.

DESCRIPTION OF THE PREFERRED EMBODIMENTS

Figure 1:
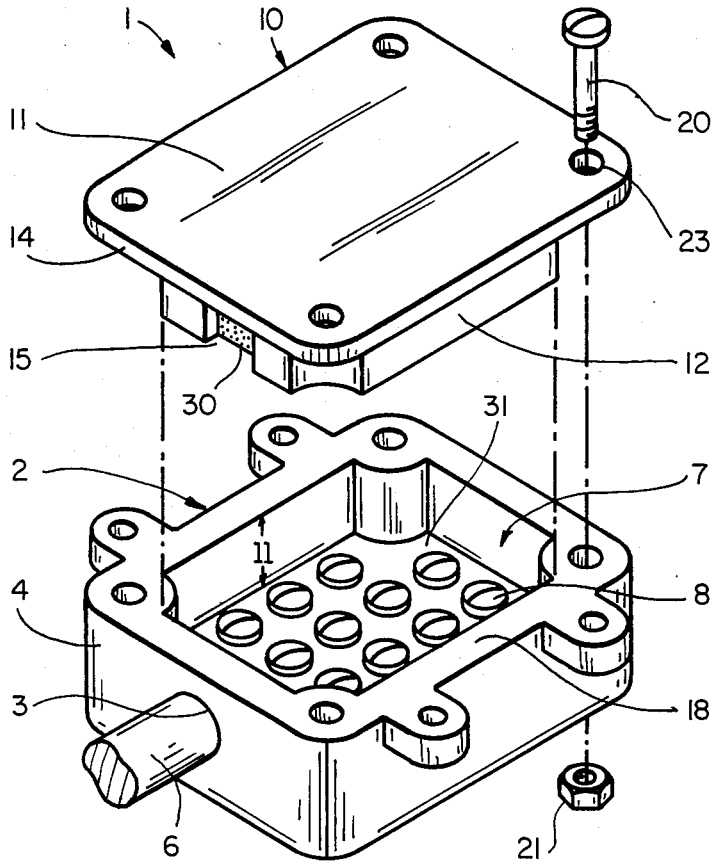
FIG. 1 is a perspective view of one embodiment of the present invention.
Figure 2:
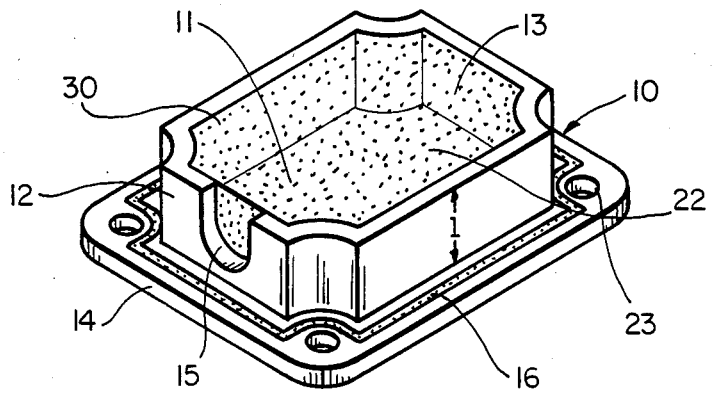
FIG. 2 is a perspective view of one of the containers illustrated in FIG. 1.

FIGS. 1 and 2 illustrate a first preferred embodiment of the invention. Referring to these figures, a first container 2 has an aperture 3 formed in a side wall 4 for receiving a cable 6 within an interior portion cavity 7 of the container 2. Reference numeral 8 represents a plurality of electrical terminations secured to a bottom wall of the container 2 to which can be connected individual ones of electrical wire within the cable 6, such terminations being typical for dropping off signals from a telephone cable 6, for example. Alternatively, the terminations 8 could represent splices between various ones of the electrical wires. In any case, the terminations 8 represent areas or surfaces where environmental protection is desireable to prevent or minimize corrosion thereat.

A second container 10 has an upper wall 11 from which extends sidewalls 12 which form a cavity 13 together with the upper wall 11. One of the sidewalls 12 has an aperture 15 which is aligned with the aperture 3 when the first and second containers are telescopically interconnected so that the cable 6 and electrical wires therein can be inserted within the containers when they are assembled. The upper wall 11 extents outward from the sidewalls 12 so as to form a flange 14, and a gasket 16 is preferably disposed on a surface of the flange and is so positioned that the gasket contacts an upper end surface 18 of the first container 2 when the first and second containers are telescopically mated, as generally illustrated in FIG. 1. Accordingly, it is readily apparent that the sidewalls 12 of the second container 10 should be positioned so as to lie directly within the sidewalls 4 of the first container 2 so as to allow the containers to be telescopically assembled and disassembled. The containers are interconnected and secured to one another by any appropriate means, nuts and bolts 21, 20 being illustrated as one preferred embodiment in FIG. 1, the nuts and bolts interconnecting aligned holes 23 on the containers respectively.

According to the invention, the second container 10 contains a three-dimensional polymeric structure type material having an open loop network, such a material being generally referred to hereafter as a gel 22, the gel 22 being disposed within the cavity 13 of the second container 10 defined by the upper wall 11 and sidewalls 12 thereof. The open loop three-dimensional polymeric structure of the gel results in the gel having finite elongation properties while being relatively soft. Specifically, it is preferred to use a gel 22 of any of the types described and claimed in U.S. Pat. Nos. 4,600,261 and 4,634,207 and in U.S. application Ser. No. 507,435 filed June 23, 1983, abandoned; all assigned to the assignee of the present invention, the disclosures of which are all incorporated herein by reference. In particular, the gel 16 preferably comprises a material having a cone penetration between 80 and 350 ($10^{-1}$ mm), preferably between 100 and 350 ($10^{-1}$ mm), more preferably between 200 and 300 ($10^{-1}$ mm), and most preferably between 240 and 270 ($10^{-1}$ mm); and an ultimate elongation of at least 50%, preferably in excess of 100%, more preferably in excess of 200–300%, and possibly in excess of 500%. All cone penetration values cited herein are determined in accordance with American National Standard Designation ASTM D217-68 on an undisturbed sample at 70° F.±5° F. using a standard 1:1 scale cone (cone weight 102.5 g, shaft weight 47.5 g), the penetration being measured after five seconds. Also, ultimate elongations are determined in accordance with the American National Standard Designation ASTM D638-80, at 70°±5° F., using a Type numeral 4 dye to cut the sample and at a speed of 50 cm/min. The gel can comprise either a urethane, silicon, or a non-silicon liquid rubber with low or no unsaturation prior to cross-linking which is then cross-linked, a preferred non-silicon liquid rubber being liquid butyl rubber. Preferably, the gel is formed so as to have a relatively tacky surface, though non-tacky gels can be used as well. The gel 22 is at least partially cured so as to have the desired cone penetration and elongation values prior to coming in contact with, or being deformed around, the substrates to be protected.

The gel 22 of the type described, due to its relatively soft nature and elastic properties as well as elongation properties tend to make an excellent water barrier for a substrate when deformed around the substrate since the gel tends to stay intact and does not ooze out and flow as does a grease, especially when subjected to temperature and humidity cycling. Preferably an adhesive strength of the gel 22 with the container 10 into which it is contained is greater than a cohesive strength of the gel to itself and an adhesive strength of the gel to the container 2 and the terminations 8 which results in the gel being secured to the container 10 when the containers 2, 10 are disassembled. The gel functions to deform around a substrate such as the terminations 8 when placed in contact therewith and held in compression thereagainst so as to be deformed therearound, a surface of the gel confronting the terminations closely adhering to the terminations to create a moisture and environmental barrier for the terminations.

According to the invention, a length 1 of the sidewalls 12 of the container 10 closely corresponds with a second length 11 of the sidewalls 4 of the container 2 such that a bottom surface 30 of the gel to be deformed comes in contact with a bottom wall 31 of the second container 10 when the flange 14 comes in contact with the upper end surface 18 of the first container 2. Accordingly, an indication of proper assembly of the apparatus 1 is provided by the seating of the flange 14 against the upper surface 18 with the result that upon such seating the bottom surface 30 of the gel 22 contacts the bottom surface 31 of the container 2 so as to eliminate any voids in the cavity 7. Further relative movement of the containers 2, 10 toward each other results in a sharp rise in torque between the nuts and bolts 21, 20 due to the seating of the flange 14 against the surface 18 which provides a ready and reliable indication of proper assembly of the apparatus 1. Accordingly, the apparatus 1 is assembled quite easily with the gel being neither overly compressed so as to cause surfaces of the container to buckle over time nor undercompressed so as to allow voids to form within the cavities 7, 13.

A further feature of the invention is the use of the gasket 16 disposed on a flange 14, the gasket 16 being positioned so as to come in contact with the upper surface 18 of the first container 2. The gasket 16 preferably has a resilience much larger than that of the gel such that the compression of the gasket again provides a sharp rise in torque and a ready indication of proper assembly of the apparatus 1. A further feature of the gasket 16 is that it provides an additional moisture barrier for the cavity 7, 13 of the apparatus 1, and specifically the gasket 16 minimizes the amount of humidity or moisture which can come in contact with the gel 22. Accordingly, the gasket 16 functions to increase the useful life of the gel 22 since the gel's exposure to the environment is minimized.

Figure 3:
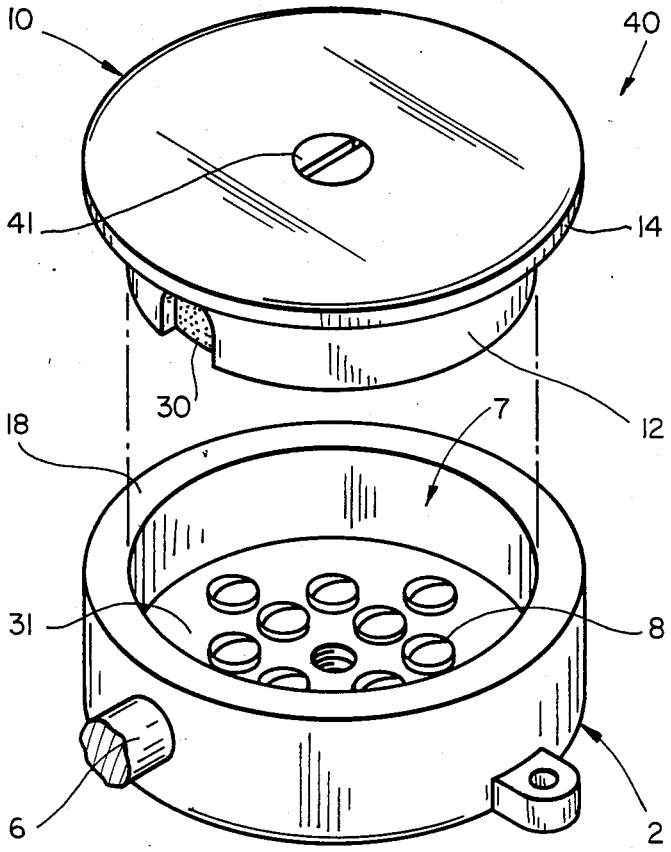
FIG. 3 is a perspective view of a second embodiment of the invention.
Figure 4:
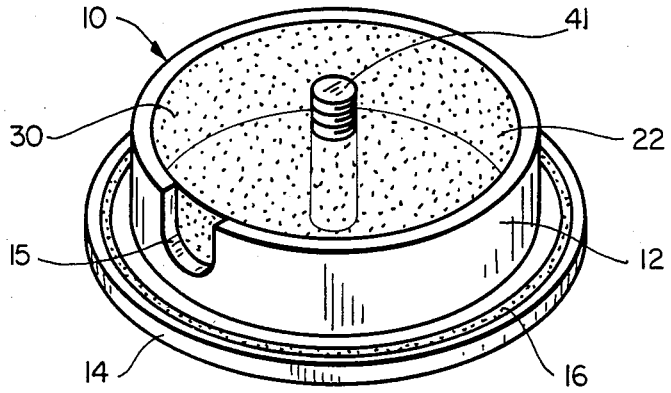
FIG. 4 is a perspective view of one of the containers illustrated in FIG. 3.

FIGS. 3 and 4 illustrate another embodiment of the invention, this embodiment being similar to the embodiment of FIGS. 1 and 2 in that again a flange 14 having a gasket 16 disposed thereon and positioned so as to come in contact with an upper surface 18 of another container are all illustrated. In FIGS. 3 and 4, an alternative securing means is illustrated than shown in FIGS. 1 and 2, the securing means comprising a screw 41 attached to the second container 10 and adapted for being threadably engaged through a bottom wall 31 of the first container 2, as compared to the nuts and bolts 21, 20 illustrated in FIG. 1. In other respects, the function and operation of the apparatus 40 in FIGS. 3 and 4 is similar to that of FIGS. 1 and 2 in that the gasket 16 seats against the upper surface 18 upon proper assembly so as to provide a sharp rise in torque reaction of the screw 41 being turned to secure the containers 2, 10 together so as to provide an indication that the apparatus 40 has been properly assembled with a bottom surface of the gel contacting the bottom surface 31 of the container 2 and filling all voids therein. Hence, a discernible force difference is recognized by a craftsman assemblying the containers 2, 10 when all voids are filled in the cavity 13, the discernible force being generated by engagement of the surface 18 with the gasket 16 since the gasket 16 has a resilience much higher than that of the gel.

Though the embodiments described illustrate the gel 22 as being disclosed totally within one of two containers, it is readily apparent that the gel could be partially disposed within both containers with a location of the substrate to be sealed being between confronting surfaces of the gel and the two containers, and such embodiments are included within the scope of the invention, such embodiments also further including mating surfaces which are designed to mate when all voids within the enclosure are filled such that a discernible force difference is recognized by the installer, and furthermore the gasket can also be preferably used to further isolate the gel from the environment and keep water away from the gel and increase its life expectancy.

Though the invention has been described with respect to certain preferred embodiments thereof, it should readily be apparent that modifications thereto can readily be made by those skilled in the art, and accordingly the invention is to be limited only by the appended claims.

What is claimed is:

1. An apparatus for protecting a substrate, comprising:

a gel having a cone penetration between 100 and 350 ($10^{-1}$ mm) and an ultimate elongation in excess of 100%, the gel having the cone penetration and elongation prior to coming in contact with the substrate;

first and second telescopically mateable containers;

means for urging the containers together such that at least one surface of the gel is deformed about a substrate to be protected;

sidewalls of the containers being formed and sized so as to be telescopically mateable, the containers being filled with the gel by amount such that when voids within the containers are substantially eliminated by urging the containers together confronting surfaces of the containers come in contact so as to substantially limit further relative telescopic movement of the containers toward one another.

2. The apparatus of claim 1, the second container including a gasket disposed around a perimeter thereof, the first container having a perimeter located so as to contact the gasket of the second container when the containers are telescopically mated so as to come in contact with one another.

3. An apparatus for receiving an electrical cable therewithin, the apparatus surrounding a portion of electrical conductors contained within the cable, comprising:

a first container having means for receiving the cable and an open side;

a second container sized so as to be telescopically mateable with the first container so as to close the first container open side, the second container having a flange therearound which bottoms on an upper side surface of the first container surrounding the open side thereof;

a gel having a cone penetration between 100 and 350 ($10^{-1}$ mm) and an ultimate elongation in excess of 100%, the gel being disposed in at least one of the containers;

means for urging the containers together so as to deform the gel about the electrical conductors;

a gasket disposed between the flange and the upper side surface;

sidewalls of the containers being sized and an amount of the gel used being such that when voids within the containers are substantially eliminated by urging the contains together the flange bottom son the upper side surface of the first container so as to substantially limit further relative telescopic movement of the containers toward one another.

4. The apparatus of claim 3, the urging means compressing the gasket between the upper side surface and the flange.

* * * * *